United States Patent [19]

Cosyns et al.

[11] 4,133,841

[45] Jan. 9, 1979

[54] PROCESS FOR UPGRADING EFFLUENTS FROM SYNTHESES OF THE FISCHER-TROPSCH TYPE

[75] Inventors: Jean Cosyns, Maule; Yves Chauvin, Le Pecq; Bernard Juguin, Rueil Malmaison; Jean-François Le Page, Rueil Malmaison; Jean Miquel, Paris, all of France

[73] Assignee: Institut Francais du Petrole, Rueil-Malmaison, France

[21] Appl. No.: 781,277

[22] Filed: Mar. 25, 1977

[30] Foreign Application Priority Data

Mar. 26, 1976 [FR] France ..... 76 09105
May 21, 1976 [FR] France ..... 76 15717

[51] Int. Cl.[2] ..... C07C 9/14; C07C 1/04

[52] U.S. Cl. ..... 260/676 R; 208/113; 260/450; 260/683.15 R; 260/683.48

[58] Field of Search ..... 260/683.15, 683.48, 260/676 R, 450; 208/113

[56] References Cited

U.S. PATENT DOCUMENTS

| | | | |
|---|---|---|---|
| 2,678,263 | 5/1954 | Glazier | 44/80 |
| 4,041,096 | 8/1977 | Kuo | 260/676 R |

*Primary Examiner*—C. Davis
*Attorney, Agent, or Firm*—Millen & White

[57] ABSTRACT

This process for upgrading effluents from syntheses of the Fischer-Tropsch type comprises several steps applied to the three cuts obtained from these effluents, i.e. a "light fraction", a "light oil" and a "decanted oil". The products are mainly gasoline, kerosene and gasoil cuts.

9 Claims, 3 Drawing Figures

PROCESS FOR UPGRADING EFFLUENTS FROM SYNTHESES OF THE FISCHER-TROPSCH TYPE

Figure 1:
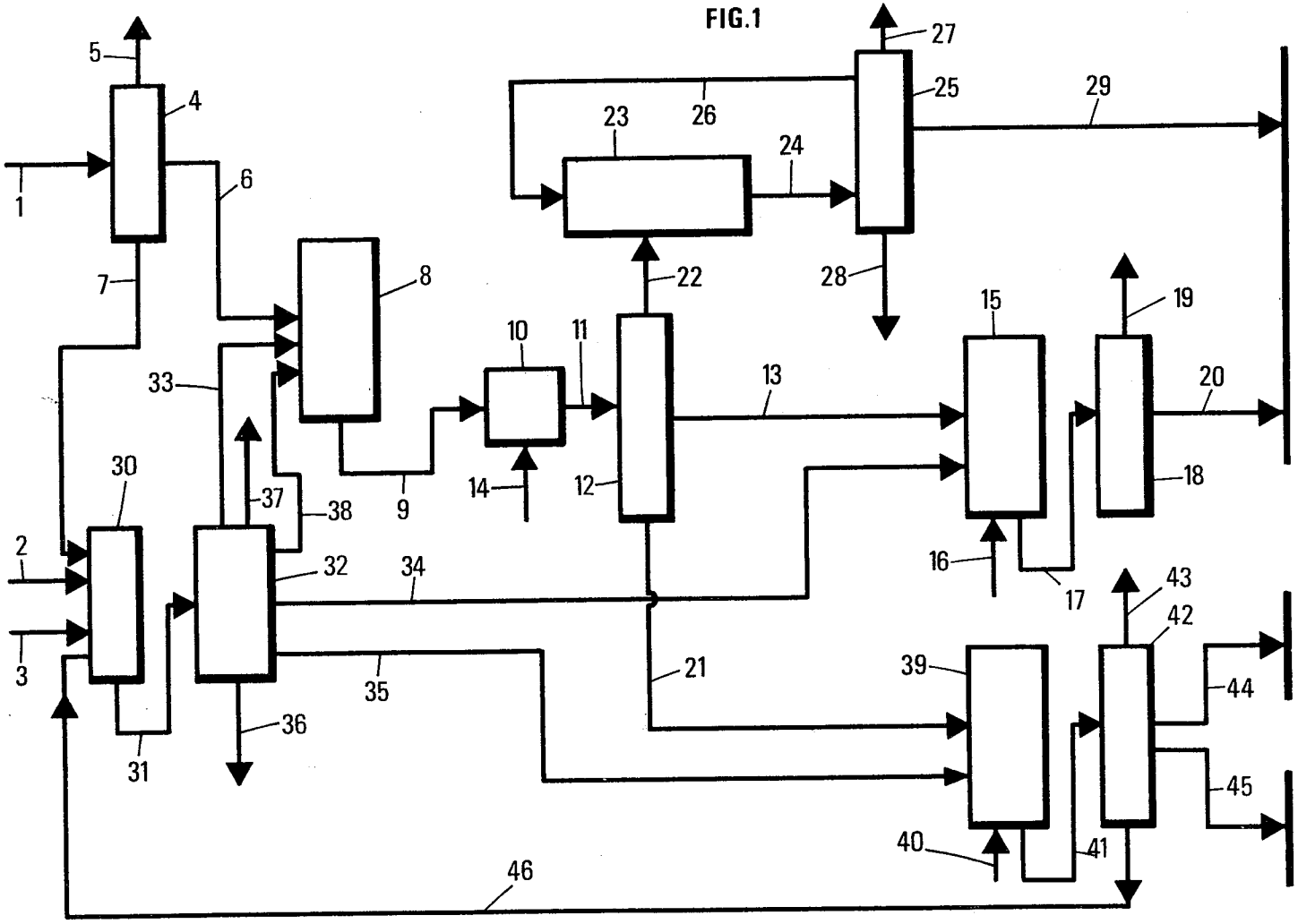

During the past years, oil has gained an important and often major position among the various power sources.

Although this importance is largely bound to the specific properties of oil, it would not have attained this level if the oil prices had not remained practically stable during bygone years.

The successive increases of the oil price during the last few years have resulted in a fresh review of the development and use of other power sources, such as coal, shales, etc. which were previously considered insufficiently profitable.

For a fairly long time, techniques for producing liquid hydrocarbons from solid combustibles and particularly from coal have been studied and used in countries which have no exploitable oil fields in their territory.

For example, solid combustible may be hydrogenated under pressure, according to the two following embodiments:

catalytic hydrogenation of the pulverized combustible in one single step. A mixture of liquid hydrocarbons may thus be obtained (for example, synthoil, H-Coal . . . processes), treatment in two successive steps: the first (not catalytic) operation comprises dissolving the combustible with a solvent in the presence of hydrogen. The resulting mixture is then catalytically hydrogenated (for example : Pittsburg Midway, Consol . . . processes).

Coal may also be gasified, to obtain a gaseous mixture which may be catalytically converted to liquid and gaseous hydrocarbons having the same use as oil and its derivatives.

These various hydrogenation (or other) processes, such as the Fischer-Tropsch synthesis, yield practically sulfur-free products (pollution problems are thus avoided) and also complex products which may contain in addition to hydrocarbons, aldehydes, ketones, fatty acids, esters, and other carboxy compounds. It is thus necessary, when upgrading these products, to treat them in a convenient manner to obtain a maximum of useful cuts such as gasoline, kerosene and gas oil cuts; this is the object of the present invention.

According to the invention, the complex mixture obtained in a reactor in which has been performed, for example, a Fischer-Tropsch synthesis is treated in a fractionation zone to obtain various fractions, each of which is thereafter treated separately to obtain industrially useful products of increased value.

The charges obtained from units for the catalytic conversion of coal, gasification products (Fischer-Tropsch and analogous conversions) may thus have different compositions depending on the variables intervening in the various processes which have produced these charges, these variables being, for example, the catalysts, pressures, temperatures, the way to employ the catalyst, etc . . .

The resulting liquid products that we use as charges in the process according to the invention may have, for example, compositions usually within the following ranges (by weight:

| | |
|---|---|
| $C_3 - C_4$ | from 4 to 30% |
| $C_5$ to $C_{11}$ | 30 to 75% |
| $C_{11}$ and more ($C_{11}^+$) | 3 to 15% |
| Oxygen compounds | 4 to 15% |

-continued

| | |
|---|---|
| Organic acids | traces to 2% |
| with an olefin percentage from about | 40 to 75% |

Figure 2:
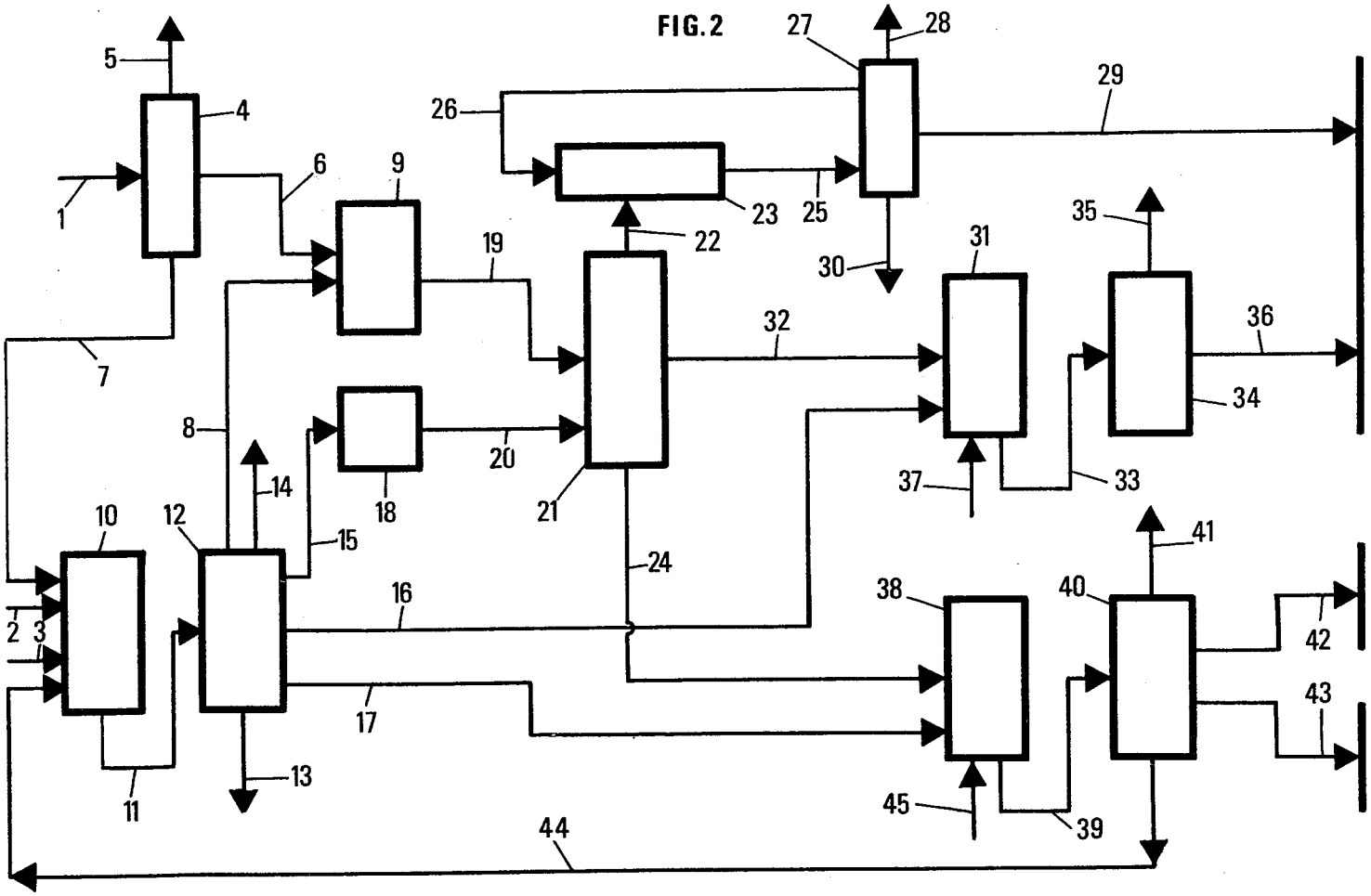
Figure 3:
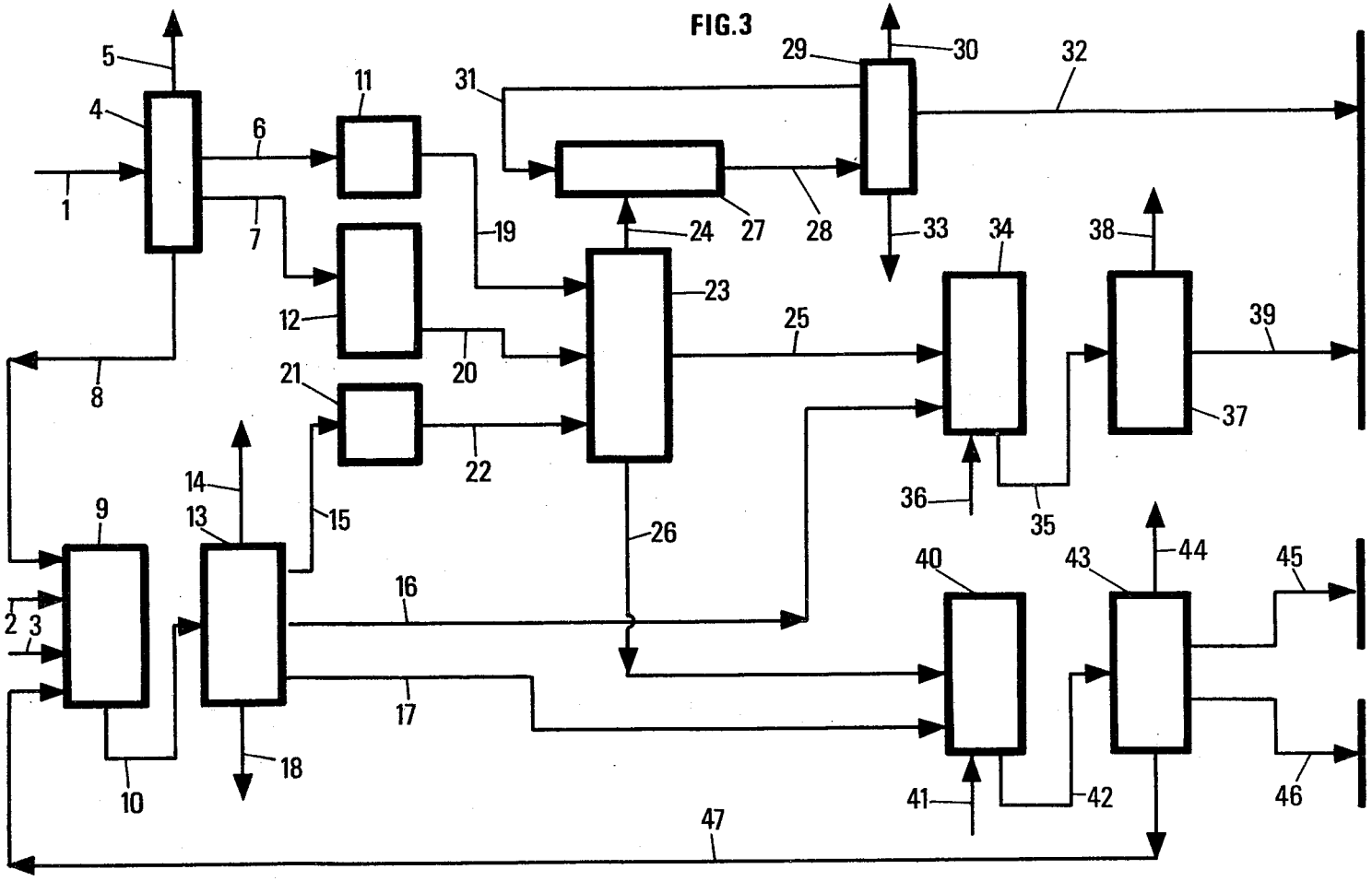

The present invention concerns a process for upgrading effluents from syntheses of the Fischer-Tropsch type or from syntheses of a similar type, these effluents usually consisting of three cuts of very high olefinic compound content. The first "light fraction" cut consists mainly of hydrocarbons having from 3 to 6 carbon atoms per molecule, these hydrocarbons being mainly unsaturated hydrocarbons the second "light oil" cut consists mainly of hydrocarbons the lightest of which may have, for example, 5 carbon atoms per molecule and the heaviest a final ASTM distillation point of about 300° C; the third "decanted oil" cut consists mainly of hydrocarbons of ASTM distillation point higher than about 300° C; each of the three cuts also contains oxygen compounds. The process is so characterized that the so-called light fraction is subjected to fractionation during which, on the one hand, a fraction comprising hydrocarbons with 5 or more carbon atoms per molecule and oxygen compounds is discharged, and, on the other hand, at least one other fraction is collected, each other fraction being fed to a polymerization zone, the effluent from the polymerization zone being then fed to a fractionation zone in order to recover (a) a fraction of high content in relatively light olefins and paraffins, (b) a fraction of high gasoline content and (c) a fraction of high kerosene and gas oil content to be treated as hereinbefore stated; the process is also characterized in that the so-called "light oil" and "decanted oil" fractions and the fraction containing hydrocarbons having 5 or more carbon atoms per molecule and oxygen compounds obtained by fractionation of the so-called "light fraction" are together subjected to a so-called cracking or cracking-decarboxylation treatment, after which the products resulting from this cracking are fractionated to obtain (a) one or more cuts containing olefins with 3 and 4 carbon atoms per molecule and relatively light saturated hydrocarbons ; at least one of these cuts is fed to at least one polymerization zone selected from said polymerization zones as above defined or another polymerization zone, and the effluents from these polymerization zones are fed to the fractionation zone following the above defined polymerization zone, (b) a so-called heavy gasoline cut and (c) a cut with an ASTM distillation point above about 200° C, which cut is admixed with said fraction of high kerosene and gas oil content resulting from the fractionation of the products obtained in the polymerization zones, and subjected to hydrotreatment in order to recover a kerosene and a gas oil fraction. FIGS. 1, 2 and 3 illustrate various embodiments of the process.

A particular embodiment of the process is described in FIG. 1.

The object of the present invention, as illustrated by the non-limitative FIG. 1, is to subject the products discharged from a process of the Fischer-Tropsch synthesis type to a plurality or a series of conversions such as to yield products having better use and value than those obtained by using, either as such or after simple fractionation, the raw charges obtained from syntheses of the Fischer-Tropsch type, since these products appear as containing substantial amounts of hardly utilizable products.

The various operations which can be combined in the process of the present invention are: distillation, polymerization alkylation, cracking, hydrogenation, decarboxylation, etc . . .

The starting materials from units of the Fischer-Tropsch synthesis type are commonly complex mixtures of several chemical species; it is thus essential to first subject them to fractionation, for example distillation, to obtain the three above individual cuts, i.e.:

1. a "light fraction" containing, for example, hydrocarbons having from 3 or 4 to 6 carbon atoms per molecule and oxygen compounds (such as carboxy compounds), this fraction being fed to pipe 1 of FIG. 1.

2. a "light oil" cut containing, for example, hydrocarbons the lightest of which have 5 carbon atoms per molecule and the heaviest an ASTM final boiling point of 300° C (the maximum boiling point of the cut is about 200° C), and also containing oxygen compounds (for example, carboxy compounds), which cut is passed through pipe 2 of FIG. 1.

3. a heavier cut called "decanted oil" whose distillation point is, for example, from 200 to 500° C and containing oxygen compounds, which cut is passed through pipe 3 of FIG. 1.

The so-called $C_3$ - $C_6$ light first cut has usually a very high content in olefinic hydrocarbons which are fractionated in zone 4. A gas fraction, usually in very low amount, is recovered from the top through pipe 5. A $C_3$ - $C_4$ fraction is recovered through pipe 6 and a heavier fraction through pipe 7, the latter being usually of the $C_5$+ type with carboxy compounds and being treated with the other two heavier fractions of the pipes 2 and 3, recovered from the synthesis of the Fischer-Tropsch type. The $C_3$ - $C_4$ fraction of pipe 6, together with the two other fractions from pipes 33 and 38, as hereinafter defined, are supplied to a polymerization zone 8 to obtain a product of high gasoline, kerosene and gas-oil content which is discharged through pipe 9.

The polymerization reactions are performed under conventional conditions, in the presence of a catalyst, for example in fixed bed, at a temperature of about 100 - 400° C, under a pressure of about 1 - 200 kg/cm$^2$ at a liquid hydrocarbon feed rate (space velocity) of about 0.05 to 5 volumes per volume of catalyst per hour. The acid catalyst is selected, for example, from silica-alumina, silica-magnesia, boria-alumina, phosphoric acid on quartz, mixtures of alumina gel with thoria, with optional addition of small amounts of chromium oxide or equivalent metal. A catalyst of the "solid phosphoric acid" type, i.e. a catalyst consisting of a silica containing material of high absorption power, impregnated with a large amount of phosphoric acid, may also be used, or also catalysts obtained by treatment of transition alumina with an acidic fluorine compounds, with optional addition of silicic ester.

The product obtained at the outlet of the polymerization zone may also, at this stage, be subjected to hydrotreatment in zone 10, in the presence of hydrogen supplied from pipe 14, in order to remove traces of actual or potential guns; the polymerization product is then transferred through pipe 11 into zone 12 where it is subjected to fractionation to separate and obtain valorized products. Thus a gasoline fraction (containing $C_5$+ with an ASTM final distillation point lower than about 200° C) may be recovered through pipe 13, and it may be subjected, before use as gasoline, to an additional hydrotreatment in zone 15 (in the presence of hydrogen supplied from pipe 16); there is also obtained a heavy fraction of ASTM initial distillation point higher than 200° C, which is also passed through line 21 to another hydrotreatment zone 39, in admixture with various fractions, as obtained from a "Fluid Catalytic Cracking" step (FCC-decarboxylation) as hereinafter explained.

A fraction, as hereunder defined, supplied from pipe 34 is also treated in the hydrotreatment zone 15. The product discharged through pipe 17 from the hydrotreatment zone 15 is gasoline of high grade. It may optionally be fractionated in zone 18 to eliminate a small top gas fraction through pipe 19, the proper gasoline fraction being discharged through pipe 20.

A fraction containing olefins and paraffins (LPG) is recovered from the top of the fractionation zone 12 through pipe 22. In fact, the conversion is not complete in the polymerization zone 8, so that there is recovered from the top of the fractionation zone 12 a fraction containing unreacted olefins and also paraffins (normal and mainly isoparaffins, for example isobutane).

At this stage it has been found that it was advantegeous to feed an alkylation reaction 23 with that mixture of paraffins and olefins at appropriate conditions of temperature, pressure and space velocity, in the presence of a convenient catalyst. The alkylation reaction is usualy carried out in the presence of a solid catalyst used in fixed bed or of a dissolved catalyst, i.e. in liquid phase, at a temperature of from −20 to 200° C, under a pressure of 0.1 to 200 atmospheres. It is thus possible to proceed in the liquid phase in the presence of a strong inorganic acid such as hydrofluoric or sulfuric acid with or without a Lewis acid such as boron trifluoride, antimony pentafluoride or aluminum trichloride and/or in the optional presence of a Bronsted acid. The operation may also be conducted in vapor phase in the presence of solid catalysts such as phosphates, arseniates or stannates of polyvalent metals with added boron trifluoride. Alkylation is also known to proceed in the presence of catalysts having a zeolitic structure, with molecular sieves, with or without silica-alumina or alumina, for example, optionally with at least one metal such as nickel, palladium, rhodium, platinum, molybdenum or uranium oxides, activated earth, etc...

More particularly, the alkylation is carried out at temperatures close to room temperature and at moderate pressure.

An alkylate is thus obtained during the alkylation; it is discharged through pipe 24 and may be fractionated in zone 25 to obtain:

LPG which is discharged through pipe 27; it contains saturated hydrocarbons (iso or normal paraffins) with 3 or 4 carbon atoms per molecule, such as butanes with a high isobutane content which can be joined to the gasoline pool, an optional fraction (pipe 26) discharged either from the top of the fractionation zone 25, as shown in FIG. 1, or from pipe 27; it has a high isobutane content and may be recycled to the alkylation zone, an alkylate useful, for example, as motor gasoline, since the alkylation products have usually clear octane numbers of from 88 to 95. This alkylate is collected through pipe 29, a minor residue which is discharged through pipe 28; it may be recycled, if desired, at least in part, either to zone 30 or to the hydrotreatment zone 15, or better to the hydrotreatment zone 39. This residue contains hydrocarbons heavier than $C_4$ (for example $C_9$+).

The second "light oil" cut (pipe 2) and the third "decanted oil" cut (pipe 3) contain, in addition to hydrocarbons, an amount of oxyhydrocarbon compounds, such as alcohols, aldehydes, acids, etc . . . and are upgraded by subjecting them to decarboxylation (or cracking) in order to convert these oxygen compounds to hydrocarbons.

Thus the product resulting from this decarboxylation will supply, after appropriate distillation, LPG, a gasoline cut, a gas oil cut, a kerosene cut and a residue.

The mixture of these products is thus passed through a cracking unit 30 in the presence of an appropriate catalyst. It is also seen that zone 30 is also used to treat the residue from the fractionation of the light cut $C_3$ - $C_6$ in zone 4, this residue being fed to zone 30 through pipe 7. It is also to be noted that zone 30 may also be used to treat at least a portion of the residue (pipe 28) from the distillation of the alkylation product carried out in zone 23. At least one fraction of this residue may also be fed from line 28 into the hydrotreatment zone 39.

The cracking or decarboxylation zone (FCC, "fluid catalytic cracking") is performed at a temperature usually of 400 to 1200° C at a space velocity of 2 to 10 volumes of liquid charge per volume of catalyst per hour. The catalyst is in fixed, moving or fluidized bed. A mobile or fluidized bed is preferable in order to maintain the catalyst in a state of optimum activity and selectivity and to prevent a too large formation of coke. A solid catalyst with acidic properties is used, selected from silica-alumina, silica-magnesia, boria-alumina, silica-zirconia, alumina with elements confering acidic properties, natural earth and minerals such as bentonite, hallosite, etc. Traces of chromium or equivalent metal may be optionally introduced into these solid masses to catalyze carbon combustion when regenerating the catalyst. Various zeolites are now used as catalysts, such as those of the alumina-silicate type (various ZMS, for example) or zeolites of the faujasite type and/or sieves of the X and Y types, etc. These catalysts are employed in the cracking zone, usually as tablets or finely divided powder, for example as microspheres.

The products discharged through pipe 31 from the cracking (FCC) unit 30 are subjected to distillation in zone 32; they yield:

an amount of uncondensable gas used as fuel (pipe 37), a condensable gas cut having a high content in $C_3$ and $C_4$ olefins, which is fed through pipe 33 to the polymerization unit 8, a light gasoline cut containing hydrocarbons with 5 carbon atoms per molecule and/or those having an approximate final ASTM point of 100° C.

This light cut of relatively low molecular weight and high unsaturated hydrocarbon content is also fed to a polymerization zone through pipe 38, in order to convert it to motor gasoline. This cut may also be collected, when fractionating, together with the previous cut (that of pipe 33) of high content in olefins with 3 and 4 carbon atoms (in other words lines 33 and 38 and joined in a single one; it is the case of example 1 hereunder).

a heavy gasoline cut with a distillation range of from about 100° C (initial ASTM point) to 200° C (final point), this cut being discharged through pipe 34, a heavier cut with an initial ASTM point of about 200° C, the latter cut being discharged through pipe 35, a residue of tar and other heavy products, discharged through line 36 and which cannot be recycled.

The heavy gasoline (ASTM distillation range of 100 - 200° C) is discharged from pipe 34 and fed (together with the $C_5$+ −200° C fraction discharged through pipe 13 from the fractionation zone for the polymerization product) to the hydrotreatment unit to be treated therein as indicated before, by partial hydrogenation, in order to improve the stability and octane number of the resulting gasolines.

As to the 200°+ cut which has been discharged through pipe 35, it is fed to hydrotreatment zone 39 also fed with hydrogen through pipe 40. This hydrotreatment zone 39 is also fed with the 200° C+ cut discharged through pipe 21 from the bottom of the fractionation zone 12. The product of the hydrotreatment zone 39 is passed through pipe 41 and fed to the prefractionation zone 42 in order to collect:

a gaseous light cut containing an excess of hydrogen fed through pipe 40; it is discharged through pipe 43, a kerosene cut discharged through duct 44, a gas oil cut discharged through pipe 45, bottoms which can be at least partly recycled to cracking zone 30 through pipe 46.

Another particular embodiment is illustrated in FIG. 2.

In FIG. 2, the so-called light first fraction is first subjected to fractionation in zone 4. From the top there is recovered, through pipe 5, a gas fraction, usually in a small amount by volume. A $C_3$ -$C_4$ fraction is discharged through pipe 6 and a heavier fraction through pipe 7, usually a $C_5$+ fraction with carboxy compounds, which will be treated with the two other heavier fractions of pipes 2 and 3 resulting from the Fischer-Tropsch synthesis. The $C_3$-$C_4$ fraction of pipe 6, together with a fraction passed through pipe 8, as hereinafter defined, is supplied to a polymerization zone 9 in order to obtain a product of high gasoline, kerosene and gas oil content which is discharged through pipe 19. The process of the invention comprises a second polymerization zone as hereinafter disclosed.

The polymerization reactions are conducted in the above conditions.

The product discharged from the polymerization zone 9 is then transferred through pipe 19, together with the products recovered through line 20 from a second polymerization zone, as hereinafter explained, to zone 21 where the two effluents from lines 19 and 20 are subjected to fractionation in order to obtain products of increased value. There is recovered, on the one hand, through pipe 32, a gasoline fraction (containing $C_5$+ having a final ASTM distillation point lower than about 200° C, which may be subjected, before use as gasoline, to hydrotreatment with hydrotreatment with hydrogen in zone 31 (in the presence of hydrogen supplied from pipe 37) in order to remove traces of actual or potential gums and, on the other hand, a heavy fraction of initial ASTM distillation point higher than 200° C, the latter being supplied through pipe 24 to another hydrotreatment zone 38, in admixture with various fractions obtained from a "Fluid Catalytic Cracking" (FCC - decarboxylation) as hereinafter explained.

In the hydrotreatment zone 31, a fraction such as above defined, supplied from pipe 16, may also be treated. The product discharged from hydrotreatment zone 31 through pipe 33 is gasoline of high grade. It may also be fractionated in zone 34 to remove a small top fraction through pipe 35, the proper gasoline fraction being then discharged through pipe 36.

On the other hand, a fraction containing olefins and paraffins (LPG) which are all $C_3$ and $C_4$ hydrocarbons, is recovered through pipe 22 from the top of the fractionation zone 21.

It is advantageous to pass this mixture of paraffins and olefins through an alkylation reactor 23 under appropriate conditions of temperature, pressure and space velocity, in the presence of a catalyst, as hereinbefore explained with respect to FIG. 1.

An alkylate is obtained during alkylation: it is discharged through duct 25 and can be fractionated in zone 27 in order to obtain, as for FIG. 1:

LPG (duct 28), if desired, a fraction (duct 26) discharged either from the top of the fractionation zone 27, as pointed out in FIG. 2, or from pipe 28. It has a high isobutane content and can be recycled to the alkylation zone, an alkylate discharged through line 29, a residue (duct 30) which can be recycled to the cracking zone 10 or to the hydrotreatment zones 31 or, better, 38.

The second cut ("light oil") and the third cut ("decanted oil") are treated in the cracking unit 10 operated under the operating conditions and with the catalysts which have been mentioned with respect to FIG. 1.

The products discharged through pipe 11 from the cracking unit (FCC) 10 are distilled and yield:

an amount of uncondensable gas to be used as fuel (duct 14), a condensable gas cut with a high $C_3$ and $C_4$ content; it is fed to the polymerization unit 9 through pipe 8, where it is polymerized in admixture with the $C_3$ and $C_4$ fraction obtained from the light fraction through duct 6, a light gasoline cut containing, among others, hydrocarbons having 5 carbon atoms per molecule and/or those having an ASTM final point of 100° C. This light cut has a relatively low molecular wieght and contains a large amount of unsaturated hydrocarbons; it is fed to a second polymerization zone 18, through pipe 15, to convert them to motor gasoline, a heavy gasoline fraction with a distillation ranging from an initial ASTM distillation point of about 100° C to a final point of 200° C, this fraction being discharged through duct 16, a heavier cut with an initial ASTM point of about 200° C, this cut being discharged through duct 17, a non-recyclable residue of tar and other heavy products which is discharged through pipe 13.

The heavy gasoline discharged through duct 16 is passed (together with the $C_5^+$ — 200° C fraction from duct 32) to the hydrotreatment unit 31 to be treated therein, as hereinbefore explained, by partial hydrogenation, thereby increasing the stability and octane number of the resulting gasolines.

As to the 200°+ cut which has been discharged through duct 17, it is supplied to the hydrotreatment zone 38 also fed with hydrogen through pipe 45. This hydrotreatment zone 38 also receives the 200° C+ cut discharged through duct 24, from the bottom of the fractionation zone 21. The product of the hydrotreatment zone 38 is discharged through duct 39 and supplied to the fractionation zone 40, thereby obtaining:

a light gas cut containing an excess of the hydrogen supplied through pipe 45; it is discharged through duct 41, a kerosene cut discharged through duct 42, a gas oil cut discharged through duct 43, bottoms which can be usefully recycled at last partly into the cracking zone 10 through duct 44.

Another embodiment is illustrated in FIG. 3.

In FIG. 3, the first cut ("light cut") of high olefinic hydrocarbon content is first fractionated in zone 4. There is obtained, through pipe 5, a top gas fraction, generally in low proportion, about 0.1 to 0.2% b.w. A fraction containing $C_3$ hydrocarbons and nearly exclusively propylene is discharged through pipe 6; all $C_4$ hydrocarbons are recovered from pipe 7 and the heaviest fraction, usually a $C_5^+$ cut containing various carboxy compounds, through duct 8. The latter fraction is treated in admixture with the two other heavier fractions ("light oil" cut and "decanted oil") from the Fishcer-Tropsch synthesis.

The $C_3$ propylene fraction from pipe 6 is supplied to a so-called first polymerization zone 11, in homogeneous liquid phase (of the conventional "Dimersol" type) in order to selectively obtain a product of high gasoline content. The latter has a high octane number and is discharged through pipe 19.

The $C_4$ fraction of pipe 7 is also fed to a so-called second polymerization zone 12 to obtain a product of high gasoline content and also middle distillates (kerosene and gas oil) which are discharged through duct 20.

To optimize the production of gasoline of high grade, there is also provided a third polymerization zone 21 where is treated a light cut of high olefin content whose origin will be mentioned later.

Each of the 3 polymerization zones is subjected to operating conditions adapted to obtain, from the charges treated therein and in the presence of selected catalysts, products of high quality with high yields.

The polymerization reactions are the same as those stated above.

It is also possible to dimerize propylene supplied from pipe 6 and/or butene from pipe 7 fairly selectively, in the liquid phase and in the presence of one of the above catalysts.

In that case, the operating conditions are similar to those given above; however the temperature, about 0 to 100° C, is generally lower than that used when proceeding to normal polymerization.

The catalysts to be used in the 3 polymerization zones usually contain associated nickel and aluminum in the form of compounds which enhance their activity and selectivity and facilitate their dissolution in the organic reaction medium.

The activity of the catalyst increases if the aluminum compound has a high and "hard" Lewis acidity on the Chato-Pearson scale. As a rule, the compounds to be used are alkyl aluminum halides. However aluminum is not the only metal of group III b sufficiently acid to catalyze the polymerization reactions; boron, indium, gallium, titanium, fluorinated compounds, tungsten and elements from group V are able to produce the same reactions.

The effluents from the three polymerization zones 11, 12 and 21 are fed respectively through pipes 19, 20 and 22 to zone 23 where they are subjected to fractionation, thereby separating and obtaining valuable products. It is clear that, although only one fractionation unit is shown in the figure, each effluent may be, if desired, subjected to a separate distillation.

During this fractionation, a gasoline fraction (containing $C_5^+$ with a final ASTM distillation point lower than about 200° C) is recovered through duct 25; it can be subjected, before use as gasoline, to hydrotreatment in the presence of hydrogen in zone 34 (hydrogen is fed from line 36) in order to remove the traces of actual and potential gums. A heavy fraction with an initial ASTM distillation point higher than 200° C is also recovered; it is fed through pipe 26 to another hydrotreatment zone 40, in admixture with various fractions from a "Fluid Catalytic Cracking" or FCC-decarboxylation as hereinafter explained.

A fraction, as hereunder defined, is supplied from pipe 16 and treated in the hydrotreatment zone 34. The product discharged from the hydrotreatment zone 34, through pipe 35, is gasoline of first grade. It may be, if desired, fractionated in zone 37 to remove a small top gas fraction through pipe 38; the proper gasoline fraction is discharged through pipe 39.

A fraction containing olefins and paraffins (LPG) is recovered through duct 24 from the top of the fractionation zone 23. Since the conversion is not complete in the polymerization zones 11, 12 and 21, there is obtained from the top of the fractionation zone 23 a fraction containing unreacted olefins and paraffins (normal paraffins and, above all, isoparaffins, for example isobutane).

It is advantageous to pass this mixture of paraffins and olefins through an alkylation reactor 27 under appropriate conditions of temperature, pressure and space velocity, in the presence of a catalyst, as explained in FIG. 1.

There is obtained, during alkylation, an alkylate which is discharged through pipe 28 and may be fractionated in zone 29 in order to obtain, as in FIG. 1:

LPG (pipe 30);

whenever desired, a fraction (duct 31) which can be discharged either from the top of the fractionation zone 29, as above in FIG. 3, or from duct 30. It contains a high proportion of isobutane and can be recycled to the alkylation zone;

an alkylate (line 32);

a small amount of residue which is discharged through duct 33; it may be recycled, at least partly, to the cracking zone 9 or to the hydrotreatment zone 34, or preferably to the hydrotreatment zone 40.

The so-called "light oil" second cut (duct 2) and the so-called "decanted oil" third cut (duct 3) are admixed with the products of pipe 8 and treated in a cracking unit 9 in the presence of an appropriate catalyst. The operating conditions and the catalysts have been defined hereabove with reference to FIG. 1.

The products discharged from the craking (FCC) unit 9 through pipe 10 are distilled in zone 13 and yield:

an amount of uncondensable gas to be used as fuel (duct 14);

at least one cut containing hydrocarbons having 3 to 4 carbon atoms per molecule up to hydrocarbons having a final ASTM distillation point of about 100° C. This cut has a high olefin content and is fed through pipe 15 to a polymerization zone 21 (for example of the polynaphtha type) called "third polymerization zone"; a product of high gasoline, kerosene and gas oil content is discharged through pipe 22 and fed, as hereinbefore explained, either to the fractionation zone 23 common to the fractionations of the effluents of pipes 19 and 20, or to an independent fractionation zone.

a heavy gasoline cut with a distillation range of from about 100° C (initial ASTM point) to 200° C (final point), which cut is discharged through duct 16;

a heavier cut with an initial ASTM distillation point of about 200° C, the latter cut being discharged through duct 17;

a residue of tar and other heavy products which cannot be recycled and is discharged through duct 18.

The heavy gasoline of duct 16 is admixed with the $C_5^+$ – 200° C fraction from duct 25 and fed to hydrotreatment unit 34 to be partially hydrogenated therein, in order to improve the stability and octane number of the resulting gasoline.

As to the 200°+ fraction which has been discharged through duct 17, it is supplied to the hydrotreatment zone 40, fed with hydrogen through duct 41. The cut 200° C+, discharged through pipe 26 from the bottom of the fractionation zone 23, is also fed to the hydrotreatment zone 40. The product of the hydrotreatment zone 40 is discharged through duct 42 and fed to the prefractionation zone 43, from which are recovered:

a light gas cut containing excess hydrogen from duct 41; it is discharged through duct 44;

a kerosene cut discharged through duct 45;

a gas oil cut discharged through duct 46;

bottoms which can be usefully recycled, at least partly, to the cracking zone 9, through duct 47.

EXAMPLE 1

By way of example (see FIG. No. 1), the three following cuts, discharged from a Fischer-Tropsch synthesis unit, are admixed to constitute 100% of the total charge to be treated according to the invention.

a light cut consisting of hydrocarbons having from 3 to 6 carbon atoms per molecule, this cut also containing carboxy compounds.

a previously called "light oil" cut containing hydrocarbons and oxygen-containing hydrocarbon molecules. This cut contains molecules having at least 5 carbon atoms per molecule and has an ASTM final distillation point up to about 300° C. It represents 46.2% b.w. of the total charge to be treated by the process of the invention.

a cut known as "decanted oil" consisting of a mixture of hydrocarbons and hydrocarbon molecules containing combined oxygen, which have a distillation range from about 300° C to 500° C. This cut represents 9.2% b.w. of the total charge to be treated by the process of the invention. 7 and According to this process, the light cut which amounts to 44.6% b.w. of the charge is first subjected to distillation in zone 4 (FIG. 1) in order to discharge through pipe 5 the hydrocarbons having less than 2 carbon atoms per molecule (in the example, they amount to 0.1% b.w. of the charge) and also to discharge a residue containing hydrocarbons with more than 5 carbon atoms and carboxy compounds (i.e., in the present example, 11.5% b.w. of the total charge). These column bottoms are discharged through line 7and treated with the two other cuts of the total charge, i.e. the light oils and decantation oils, in the FCC decarboxylation zone 30.

At the outlet from the separation zone 4, there is obtained, in pipe 6, a cut containing only $C_3$ and $C_4$ hydrocarbons, and representing 33% b.w. of the total charge to be treated by the process of the invention.

This cut has a high $C_3$ and $C_4$ olefin content; its unsaturated hydrocarbon content is 68% b.w., i.e. 22.4% b.w. of the total charge. This cut is passed to a polymerization unit 8 to convert the light olefinic hydrocarbons to gasoline and middle distillates as hereinafter explained.

The bottoms of the distillation column 4 are fed to the FCC decarboxylation zone 30. The two light oil and decanted oil cuts are also introduced into zone 30 through the respective ducts 2 and 3.

The mixture obtained from the 3 fractions of ducts 7, 2 and 3 and supplied to zone 30 has, in the present example, the following properties:

| | | |
|---|---|---|
| density at 15° C | | 0.785 |
| bromine number (g/100 g) | | 79 |
| acid number (mg KOH/g) | | 5.8 |
| distillation : | | |
| | initial point | 33° C |
| | 50% point | 171° C |
| | final point | 510° C |
| | % distillate | 98.5 |

This charge, amounting to 66.9% b.w. of the total of the products treated according to the present invention, is thus contacted in zone 30 with a solid catalyst which, in the present case, is synthetic alumina-silica containing 85% $SiO_2$ and 15% $Al_2O_3$.

The operating conditions were:

- volume velocity: 4 vol. liquid charge per vol. catalyst per hour
- temperature: 460° C
- pressure: atmospheric.

The products discharged from reactor 30 are cooled; at that moment; the acid number which was 5.8 (mg KOH/g) before the FCC step becomes lower than 0.01, which shows the effect of decarboxylation; the products are discharged through pipe 31 and then fractionated (zone 32) to obtain 5 cuts:

(a) a gaseous cut (pipe 37) containing hydrocarbons with less than 3 carbon atoms per molecule. This cut amounts to about 0.3% by weight of the whole quantity of the products to be treated, i.e. the initial charge, and 0.45% of the charge supplied to FCC 30, without taking into account recycle from a further hydrotreatment through line 46.

(b) a cut comprising hydrocarbons with 3 and 4 carbon atoms per molecule (particularly olefins whose content is higher than 50% b.w.: 53%) up to hydrocarbons having an ASTM final distillation point of 100° C. This cut amounts to 29.5% b.w. of the total charge and 35.87% of the effluent from zone 30 of the FCC, without including the recycle from pipe 46. Thus cut (b) concerns both pipes 33 and 38 of FIG. 1. There is thus here a single pipe 33 – 38 instead of 2 distinct pipes.

(c) a heavy gasoline cut (pipe 34) with a distillation range from 100 to 200° C, which amounts to 22.4% of b.w. of the total feed treated by the present process and 33.48% of the effluent from the FCC 30, without including the recycle from the pipe 46.

(d) a 200° $C^+$ cut (200° C to about 380° C) through pipe 35, from which we can obtain kerosene and gas oil by appropriate treatment as hereinafter disclosed. This cut amounts to 19.3% of the total initial charge and 22.87% of the mixture subjected to FCC. and (e) a residue with code (pipe 36) which amounts to 5.9% of the total charge and 8.82% of the FCC charge, without including the recycle from pipe 46. This residue is discharged.

The cut from line 6 is admixed with the cut (b) from the common duct 33–38 of FIG. 30. This mixture amounts to 57% of the total charge treated according to the invention; it is relatively light and has a high olefinic content, since the $C_3$ – $C_4$ fraction of duct 6 contains 69% b.w. thereof and the $C_3$ – 100° C fraction of the 33 – 38 duct has a bromine number of 165 and contains 53% b.w. of olefins; this mixture is subjected to catalytic polymerization of the "polynaphtha" type to convert the olefins of low molecular weight to gasoline and middle distillates; the catalyst is silica-alumina as balls.

The operating conditions, in the polymerization zone 8, are the following:

- volume velocity: 2 volumes of charge per volume of catalyst per hour
- temperature: 200° C
- pressure: 40 bars.

The products discharged from the polymerization zone 8 are fed directly to the fractionation column 12, from where are discharged:

(a) from the top of the column, through duct 22, gaseous products containing hydrocarbons with less than 5 carbon atoms per molecule, i.e. mainly $C_2$ and $C_4$ hydrocarbons, amounting to 14.6% of the total charge treated according to the invention and 23.3% of the charge subjected to polymerization.

(b) a gasoline $C_5$ – 200° C fraction through duct 13. It amounts to 29.2% of the total charge treated according to the invention and 46.7% of the charge subjected to polymerization This fraction is admixed with the 100 – 200° C heavy gasoline cut of pipe 34 in order to be hydrotreated, thereby upgrading these products.

(c) a bottom fraction through duct 21. It amounts to 18.7% b.w. of the total initial charge and 29.9% of the charge subjected to polymerization. This fraction consists of products having a distillation point higher than 200° C. It is discharged through duct 21, subjected to hydrotreatment and to distillation in admixture with the 200° $C^+$ fraction of duct 35, as explained hereunder, in order to obtain a kerosene cut and a gas oil cut.

The gas products of pipe 22 are essentially hydrocarbons having 3 and 4 carbon atoms per molecule; they also contain unpolymerized $C_3$ and $C_4$ olefins since polymerization is not complete, but only in a proportion of about 90%.

In the present invention, the fraction of duct 22 contains 18.2% b.w. of olefins; it also contains a substantial amount of isobutane: 53.2% b.w. in the present case. At this stage, it is advantageous to subject the cut from pipe 22 to appropriate alkylation to obtain a high alkylate yield, which alkylate can be used as motor gasoline. In this way, it is possible to recover nearly all the olefins and a substantial portion of isobutane. The alkylation reaction is conducted at temperature close to room temperature and at moderate pressure.

The cut from pipe 22 has been alkylated in the presence of hydrofluoric acid. In fact, hydrofluoric acid, as well as 98 – 100% sulfuric acid, is one of the most selective catalyst; its use is easy, and its catalytic activity can be controlled easily. The activity of such catalysts decreases with time, as complex form with diolefins and the charge becomes diluted with traces of water introduced with the feed.

When using sulfuric acid, the latter is consumed in substantial amount since, once contacted with the charge, it cannot be recovered in practice; it is however unexpensive.

Conversely hydrofluoric acid, although more expensive as sulfuric acid is finally less expensive since it may be recovered easily by distillation.

Now when working with hydrofluoric acid, a large excess of isobutane in the catalytic alkylation zone limits the secondary polymerization reaction, and decreases the amount of isobutane recovered in the alkylate or valorized as alkylate. Thus, since in the present example there is obtained a large excess of isobutane (51.8% b.w.

for 18.2% olefins with 3 or 4 carbon atoms) it is advantageous to recycle at least a portion of this excess to the alkylation reactor 23 through duct 26; in the present example the ratio isobutane/olefins is maintained at a value of about 10, thereby making the alkylation reaction easier, although limiting the formation of heavy products.

Another advantage of the use of hydrofluoric acid is that it remains selective in a temperature range broader than that used with sulfuric acid, which permits to operate at temperatures compatible with the use of water for cooling (10 to 50° C for HF and 0 to 10° C for $H_2SO_4$).

The alkylation is conducted in reactor 23 which is stirred and cooled in order to maintain the temperature of the reaction mixture at 32° C under a pressure of 14 bars.

i-$C_4$/olefins ratio: 10 volume of HF (85% b.w.) per hour and per olefin volume unit: 2 acid/hydrocarbon volume ratio: 1.

After decantation, separation, washing and distillation in column 25, there is obtained:

1. in pipe 29: 5.80% b.w. (with respect to the total initial charge to be treated according to the invention) of gasoline alkylate, i.e. 39.7% of LPG fed through duct 22 to the alkylation zone 23.

2. 0.2% b.w. of bottoms through duct 28.

3. and 8.6% b.w. of LPG (duct 27) containing a portion of unreacted isobutane, the other portion of isobutane being recycled to the alkylation reactor 23, through duct 26, in order to maintain an appropriate iso $C_4$/olefin ratio; in this example, the ratio is 10, the portion of recycled isobutane being 45% b.w. of the charge to be alkylated, as supplied from line 22. Since the LPG obtained as head fraction (line 27) consists mainly of $C_4$ (butanes), it may be fed in part or totality to the gasoline pool.

The $C_5$ – 200° C gasoline fraction obtained through duct 13 from the polymerization stage, and the 100 – 200° C heavy gasoline fraction obtained through duct 34 from the cracking-decarboxylation zone 30, together amount to 51.6% b.w. of the total initial charge to be treated. These two gasolines have still a high gasoline content. The mixture of these two gasolines has the following properties:

density 15° C: 0.741 olefins: 77.5% by volume (4% of diolefins); bromine number: 124 octane number $F_1$ (tetraethyl lead - 2 cc per gallon): 92.

This gasoline mixture has a high diolefin content: the latter must then be removed to permit use of this mixture as fuel quality. The two gasolines are then selectively hydrogenated in the hydrotreatment zone 15, so as to remove these diolefins. The diolefins react very quickly in zone 15 with a minimum decrease of the octane rating.

This selective hydrogenation is carried out with a catalyst of the trade (Procatalyse LD 265) which is a palladium-on-alumina catalyst whose particle size is 3 mm.

The operating conditions were the following:

pressure: 60 bars temperature: 190° C hydrogen/hydrocarbon ratio: 0.2 volume velocity expressed as volume of charge/volume of catalyst: 1.5.

A strict control of the hydrogen supply has permitted to stop at an optimal point: maximum removal of diolefins, so as to obtain a potential and actual gum content lower than the standard value, while retaining satisfactory octane rating and lead susceptibility; the hydrotreatment may be so controlled as to obtain a hydrogenation rate of about 80%. It has also been found that, since this control of the hydrogenation rate to 80% cannot be always easily obtained, it is possible to have recourse to another method consisting of dividing the mixture of the two gasolines of the two ducts 13 and 34: a fraction amounting to about 80% of the mixture will be fully hydrogenated under the above conditions, while the other 20% will not be subjected to hydrogenation but will be admixed with the products discharged from the hydrogenation zone.

In other words, these 20% of the initial mixture are by-passed from the hydrotreatment zone. When operating under these conditions which suppose no particular technical problem, it has been found that the resulting product (thus a mixture of the hydrogenated fraction with the non hydrogenated fraction) had substantially the same properties as the mixture obtained after 80% partial hydrogenation of the total mixture of lines 13 and 34. Thus with a partial 80% hydrogenation or a total hydrogenation with 20% by-passing, the final main product was found to have the following properties:

density at 15° C: 0.737

$F_1$ octane number (lead - 2 cc per gallon): 93.8.

The 200+° C cut obtained through duct 35 from the cracking decarboxylation is also hydrotreated in zone 39 with the bottom effluent withdrawn from the duct 21, in order to improve the stability, the color and the odour of the final products and in order to increase the cetane number of the gas-oil cut which is obtained after the fractionation step. This hydrotreatment is carried out in the zone 39 where is also treated the 200° C+ cut discharged through duct 21 from the bottom of the fractionation zone 12 where was conducted the fractionation of the products recovered from the polymerization zone 8. This hydrotreatment has been carried out with the same catalyst of the palladium-on-alumina type as used for hydrotreating the gasoline mixture in zone 15.

The operating conditions were:

pressure: 60 bars temperature: 320° C volume velocity: 2 volumes of charge per volume of catalyst per hour.

After distillation of the resulting products in zone 43, two cuts were obtained: a kerosene cut (200 – 250° C) in duct 44 and a gas oil cut (250 – 360° C) in duct 45.

The resulting kerosene cut (200 – 250° C) amounting to 13.6% b.w. of the total initial charge subjected to the treatment according to the invention, has the following properties:

density 15° C: 0.823 bromine number: 0.1 smoke point mn: 30 freezing point ° C: < – 70° C.

The resulting gas oil cut (250 – 360° C), which amounts to 13.7% b.w. of the total initial charge subjected to the treatment according to the invention, has the following properties:

density at 15° C: 0.862 bromine number: 0.03 pour point (° C): – 55 cetane number: 60

A heavy oil (or bottom residue) is also discharged through duct 46; it may be usefully recycled to the FCC cracking zone 30. This bottom residue amounts to 10.5% b.w. of the total charge.

Thus, when treating according to the invention, the three complex charges from a Fischer-Tropsch synthesis, there is obtained products of quality with high yields which are given thereafter as percentage of the total initial charge, i.e. with respect to the three fractions of pipes 1, 2 and 3:

8.6% b.w. of LPG (duct 27) essentially butanes,
51.6% b.w. of motor gasoline (ducts 29 and 20),
13.6% b.w. of kerosene (duct 44),
13.7% b.w. of gas oil (duct 45).

EXAMPLE 2

The feed charge of example 1 is treated in conformity with FIG. 2.

As in example 1, the light cut amounting to 44.6% b.w. of the total charge is subjected to distillation in zone 4 (see FIG. 2); the hydrocarbons having less than 2 carbon atoms per molecule (0.1% b.w. of the charge in the example) are discharged through duct 5.

At the outlet of the separation zone 4, there is obtained in pipe 6 the same cut as in example 1, which cut contains only $C_3$ and $C_4$ hydrocarbons and amounts to 33% b.w. of the total charge to be treated according to the process of the invention.

This cut is fed to the polymerization unit 9.

The bottoms of the distillation column 4 (11.5% b.w. of the total charge) are fed to the FCC decarboxylation zone 10. The two cuts, "light oil" and "decanted oil" are also fed to zone 10 through ducts 2 and 3.

The mixture fed to zone 10 of the 3 fractions of the pipes 7, 2 and 3 has, in the present example, the same characteristics as in example 1; it is treated in zone 10 under the same operating conditions and with the same catalyst as in example 1.

The products discharged through duct 11 are thereafter subjected to fractionation (zone 12) to obtain 5 cuts:

(a) a gas cut (duct 14) of composition identical to that of pipe 37 of FIG. 1 in example 1.

(b) a cut containing hydrocarbons with 3 to 4 carbon atoms per molecule and which represents 5.4% b.w. of the whole charge. This cut has a high $C_3$ and $C_4$ olefin content (67.5% b.w.); it is fed to the polymerization unit (9) through pipe 8, where it is treated in admixture with the $C_3$ and $C_4$ cut obtained by fractionation of the light cut $C_3$ and $C_4$ and discharged through duct 6.

(c) a light gasoline cut containing hydrocarbons ranging from those having 5 carbon atoms per molecule to those whose ASTM final boiling point is 100° C. This cut represents 24.4% b.w. of the total charge and 36% of the effluent from zone 10 of the FCC, without including the recycle from pipe 44. This cut has the following properties:

$d^{15°} = 0.695$
bromine number = 168
acid number (mg KOH/g) = 0.6

This cut is fed through duct 15 to a second polymerization reactor 18 operating under conditions optimized for that cut, which permits valorization of this cut, thereby obtaining gasoline of first grade and middle distillates yielding kerosene and gas oil of excellent quality.

(d) a heavy gasoline cut (duct 16)

(e) a 200° $C^+$ cut (duct 17)

(f) a residue with coke (duct 13); the cuts (d), (e) and (f) have substantially the same composition as the cuts (c), (d) and (e) of pipes 34, 35 and 36 in example 1.

The cut of line 6 is admixed with the cut (b) from line 8 of FCC 10. This mixture amounts to 38.4% of the total charge treated according to the invention; it is relatively light and has a high olefin content since the fraction $C_3$ - $C_4$ of duct 6 contains 69% b.w. of olefins and the fraction of duct 8 contains 67.5% b.w. of olefins; this mixture is subjected to catalytic polymerization of the "polynaphtha" type in order to convert the olefins of low molecular weight to gasoline and middle distillates; the catalyst is silica-alumina as balls.

The operating conditions in the polymerization zone 9 are the following:

space velocity: 2 volumes of charge per volume of catalyst per hour
temperature: 200° C
pressure: 40 bars.

The cut (c) ("$C_5$ - 100° C gasoline") from the FCC (10) is passed through duct 15 and subjected to catalytic polymerization in a second polymerization reactor (18) where the operating conditions differ somewhat from those of the polymerization zone 9, in order to optimize them for the treatment of the heavier fraction of pipe 15, as compared to the fractions of ducts 6 and 8. In zone 18 the pressure and temperature are slightly higher than in zone 9, while the space velocity is slightly lower. The catalyst is the same for zones 9 and 18. As a rule, in the first polymerization zone, the temperature is lower by 5 to 20° C, preferably by 8 to 15° C, than the temperature of the second polymerization zone; in the first polymerization zone, the pressure is lower by 2 to 10 bars, preferably 4 to 6 bars, than the pressure in the second polymerization zone; finally, in the first polymerization zone, the volume velocity is greater by 0.1 to 0.5, preferably by 0.2 to 0.4 volume of charge per volume of catalyst per hour, than the volume velocity in said second polymerization zone.

In this example 2, the polymerization zone 18 is operated as follows:

space velocity: 1.7 vol. of feed charge per vol. of catalyst per hour
temperature: 210° C
pressure: 45 bars.

The products discharged from the polymerization zones 9 and 18 are supplied directly to the fractionation column 21 from where various fractions are discharged, each having substantially the same composition as, in example 1, at the outlet from the fractionation zone 12 of FIG. 1. These fractions, together with the cuts from ducts 34 and 35, are treated as in example 1 to obtain alkylate, gasoline, kerosene and gas oil cuts with yields close to those obtained in example 1. The addition of a second polymerization zone in example 2 may seem useless since the same results as in example 1 have been obtained. However the possible choice between 1 or 2 polymerization zones permits, depending on the charges available in pipes 1, 2 and 3, to adapt the process to an increased production of gasoline, kerosene or gas oil in accordance with the demand.

EXAMPLE 3

The charge of example 1 is treated, by way of example, according to FIG. 3.

As in example 1, the light cut which amounts to 44.6% b.w. of the total charge is subjected to distillation in zone 4 (see FIG. 3); hydrocarbons with less than 2 carbon atoms per molecule are discharged through duct 5 (0.1% by weight of the charge in the present example). The $C_5^+$ fraction amounting to 11.5% b.w. of the total charge is also discharged through duct 8 and fed to the FCC zone 9.

At the outlet of the separation zone 4, there is obtained in duct 6 a cut containing only $C_3$ hydrocarbons, which cut amounts to 16.9% b.w. of the charge to be treated according to the process of the invention.

This cut is mainly olefinic and contains practically only propylene (99.5% b.w.). It is fed to a polymerization unit 11 of the "Dimersol" type to transform the light olefinic hydrocarbons mainly to gasoline and some middle distillates. In unit 11, the cut of line 6 is mainly dimerized to highly branched $C_6$ olefins.

The catalyst is a "complex" soluble in the reaction medium, which medium is here in the liquid state.

The catalyst contains nickel and aluminum associated as a "complex" and it is added continuously to the reaction medium, so that the liquid phase contains 0.05% b.w. of aluminum and 0.0075% b.w. of nickel.

The operating conditions, in the polymerization zone 11, are the following:

temperature: 40° C pressure: 4 bars contact time: 3 hours.

The reaction is conducted in the liquid phase, which permits an easy control of the exothermicity of the process.

Gaseous ammonia is injected at the outlet of the reactor, in order to destroy the catalyst and eliminate it from the reaction products. The resulting products are then washed with water to remove the catalyst decomposition products, and then decanted.

The rate of conversion of propylene to liquid products is 97.5% b.w.; the remaining 2.5% consist of propylene.

The liquid product contains (except propylene):

73% b.w. of $C_6$ olefins

20% b.w. of $C_9$ olefins

7% b.w. of olefins higher than $C_9$.

The organic phase containing the reaction products and the unreacted constituents, i.e. propylene, is fed through pipe 19 to the fractionation column 23.

At the outlet of the separation zone 4, there is also obtained through duct 7 a cut containing only $C_4$ hydrocarbons, which cut represents 16.1% b.w. of the total charges to be treated in the invention; this cut has a high olefin content of 85% b.w.

This cut is fed to the second polymerization unit 12 of the "solid phosphoric acid" type in order to optimize the specific conversion of the olefins contained in that cut to gasoline of high grade and also to a small amount of middle distillate.

This polymerization is carried out in zone 12 with a catalyst of phosphoric acid deposited on silica, as extrudates of about 3 mm diameter. The $P_2O_5$ content of the catalyst is about 65% b.w.

The operating conditions in the polymerization zone 12 are:

temperature: 225° C pressure: 50 bars hourly space velocity of the liquid charge: 4 times the catalyst volume.

water content of the charge: 400 ppm.

The resulting product, discharged from line 20, contains:

3.4% b.w. of $C_4$ hydrocarbons (30% olefin content)

11.9% b.w. of gasoline 0.8% b.w. of a fraction distilling above 200° C (the percentages are always given with respect to the total amount of charge to be valorized according to the invention).

The product from pipe 20 is fed to the fractionation column 23 where it is distilled in admixture with the other effluents from the two other polymerization zones 11 and 21.

The bottom product from the distillation column 4 is supplied through pipe 8 to the FCC decarboxylation zone 9. The latter zone 9 also receives the two cuts, "light oil" and "decanted oil" through the pipes 2 and 3.

The mixture of the 3 fractions from the ducts 8, 2 and 3 has, in the case of the present example, the same characteristics as in example 1 and is treated in zone 9 in the same operating conditions and with the same catalyst as in example 1.

The products discharged through pipe 10 are then subjected to fractionation (zone 13) to yield 4 cuts:

(a) a gas cut (duct 14) containing hydrocarbons with less than 3 carbon atoms per molecule. This cut amounts to about 0.3% of the total weight of the products to be treated, i.e. the initial charge and 0.45% of the charge supplied to FCC 9, without including the recycle of a further hydrotreatment product through line 47.

(b) a cut comprising hydrocarbons with 3 and 4 carbon atoms per molecule (a strongly olefinic cut whose olefin content is higher than 50% b.w., i.e. 53%) up to those having an ASTM final distillation point of 100° C. This cut amounts to 29.5% b.w. of the total charge and 44.1% of the effluent from zone 9 of the FCC, without including the recycle through duct 47.

(c) a heavy gasoline cut (duct 16) with a distillation range of 100 - 200° C, which amounts to 22.4% b.w. of the total charge to be treated in the present process and 33.48% of the effluent from FCC 9 without including the recycle from duct 46.

(d) a 200° $C^+$ cut (duct 17) which is converted to kerosene and gas oil after an appropriate treatment such as hereinafter explained.

This cut represents 19% of the total initial charge to be treated and 28.4% of the mixture subjected to FCC.

(e) a residue with coke (duct 18) which amounts to 5.4% of the total charge and 8.0% of the FCC charge, not including the recycle through duct 47. This residue is discharged.

The "light" cut (b) recovered through duct 15 from the FCC 9 has a density of 0.657 at 15° C and a bromine number of 195 (58% b.w. of olefins); this mixture is subjected to catalytic polymerization of the "polynaphtha" type in reactor 21 in order to convert olefins of low molecular weight to gasoline and middle distillates; the catalyst may be silica-alumina as balls.

The operating conditions in the polymerization zone 21 are:

volume velocity: 2 volumes of charge per volume of catalyst per hour temperature: 200° C pressure: 40 bars.

The products discharged from the polymerization zone 21 are directly supplied to the fractionation zone 23 where they are distilled in admixture with the other products from the two other polymerization zones 11 and 12.

During this distillation, there is obtained:

(a) from column top, through duct 24, gaseous products containing hydrocarbons with less than 5 carbon atoms per molecule, i.e. mainly $C_2$ and $C_4$ hydrocarbons, which amounts to 5.6% of the total charge treated according to the invention and 9% of the total charge subjected to polymerization.

(b) a $C_5$ - 200° C gasoline fraction, through duct 25, which amounts to 39.1% of the total amount of the charge treated according to the invention and 62.5% of the charges subjected to polymerization. This fraction will be admixed with the 100 – 200° C heavy gasoline cut from duct 16 and thereafter hydrotreated for valorization of these materials.

(c) column bottoms, through duct 26, which amount to 17.8% b.w. of the total initial charge and 28.5% of the charges subjected to polymerization. These column bottoms consist of products of distillation point higher than 200° C; they are discharged through duct 26 and subjected to hydrotreatment and distillation in admixture with the fraction 200°+ of pipe 17, as hereinafter explained, to yield a kerosene cut and a gas oil cut.

The gaseous products from duct 24 consist essentially of hydrocarbons with 3 and 4 carbon atoms per molecule; they also contain unpolymerized $C_3$ and $C_4$ olefins since polymerization is not complete, the conversion being as an average about 90%.

In the present example, the fraction from duct 24 contains 18.2% b.w. of olefins and substantial amount of isobutane: 53.2% b.w. of that cut in the present case. The cut from line 24 is subjected to an alkylation reaction.

Alkylation has been conducted in reactor 27 in the presence of hydrofluoric acid and under the same operating conditions as in example 1.

After decantation, separation, washing and distillation in column 29, there is obtained:

1. in duct 32: 2.2% b.w. (with respect to the total charge to be treated in the invention) of gasoline alkylate, which represents 39.3% of the LPG supplied from duct 24 into the alkylation zone 27, 2. 0.1% b.w. of columns through duct 33, 3. and 3.3% b.w. of LPG (duct 30) containing a fraction of unreacted isobutane, the other isobutane fraction being recycled to the alkylation reactor 27 through duct 31, thereby maintaining an appropriate iso $C_4$/olefin ratio; in this example, this ratio is 10 and the amount of recycled isobutane represents 45% b.w. with respect to the alkylation charge of line 24.

The $C_5$ - 200° C fraction discharged through duct 25 from the polymerization zones, and the 100 – 200° C heavy gasoline fraction discharged through duct 46 from the cracking decarboxylation zone 9 together represent 61.5% b.w. of the total initial starting charge. These two gasolines have a high olefin content. The mixture of these two gasolines has the following properties:

density at 15° C: 0.740 olefins: 79.5% by volume (4% diolefins), bromine number: 126 octane number $F_1$ (tetraethyl lead - 2 cc/gallon: 93.

This gasoline mixture has a high diolefin content, and the latter must be removed: the two gasolines are then hydrogenated selectively in the hydrotreatment zone 34 where the diolefins react quickly with limited decrease of the octane number.

This selective hydrogenation is conducted as in example 1, in zone 15 of FIG. 1. The hydrogenation rate selected for this hydrotreatment is about 80%.

The useful product had the following properties:

density at 15° C: 0.735

$F_1$ octane number (lead - 2 cc/gallon: 94.1.

The 200° C+ cut discharged through duct 17 from the cracking-decarboxylation is also subjected to hydrotreatment in zone 40, together with the bottoms withdrawn through line 26 from the fractionation zone 23, to improve stability, color and odor of the final products and increase the cetane number of the gas-oil cut obtained by fractionation.

The catalyst of the palladium-on-alumina type used for this hydrotreatment, in the same as that used for the hydrotreatment of the gasoline mixture in zone 34.

The operating conditions were the following:

pressure: 60 bars temperature: 320° C volume velocity: 2 volumes of charge per volume of catalyst per hour.

After distillation of the resulting products in zone 43, two fractions are obtained: a kerosene fraction (200 – 250° C) through duct 45 and a gas oil fraction (250 – 360° C) through duct 46.

The kerosene fraction (200 –250° C), which amounts to 12.4% b.w. of the total initial charge treated according to the invention, has the following properties:

density at 15° C: 0.825 bromine number: 0.15 smoke point mn: 32 freezing point °C: < −70° C.

The gas oil fraction (250 – 360° C), which amounts to 14.2% by weight of the total initial charge treated according to the invention, has the following properties:

density at 15° C: 0.860 bromine number: 0.01 pour point (°C): − 56 cetane number: 59.

A heavy oil or residual bottoms is also discharged through duct 47; it may be usefully recycled to FCC cracking zone 9. This bottom residue amounts to 10.2% b.w. of the total amount of the charges to be valorized according to the invention, i.e. of the total charge.

Thus, when treating in example 3, the three complex charges issued from a Fischer-Tropsch synthesis, products of high quality are obtained with yields which, given in % of the total initial charge, i.e. of the whole of the three fractions from pipes 1, 2 and 3, are as follows:

3.3% b.w. of LPG (duct 30), essentially butanes which can be fed to the gasoline pool;

63.7% b.w. of motor gasoline (ducts 32 and 39);

12.4% b.w. of kerosene (duct 45);

14.2% b.w. of gas oil (duct 46).

What we claim as our invention is:

1. A process for upgrading effluents from syntheses of the Fischer-Tropsch type or of substantially the Fischer-Tropsch type, these effluents being generally formed of three cuts, which have been obtained by fractionating the product of the Fischer-Tropsch synthesis, the first cut or "light fraction" comprised largely of hydrocarbons with 3 to 6 carbon atoms per molecule, these hydrocarbons being largely unsaturated, the second cut or "light oil" comprised largely of hydrocarbons the heaviest of which have an ASTM final distillation point of about 300° C, the third cut or "decanted oil" comprised mainly of hydrocarbons of ASTM distillation point higher than about 300+ C, each of the three cuts also containing oxygen compounds, the process being so characterized that the said light fraction is subjected to fractionation during which, on the one hand, a fraction is discharged, which fraction comprises hydrocarbons with 5 or more carbon atoms per molecule and contains oxygen compounds, and, on the other hand, a fraction is collected, this fraction being fed to a polymerization zone in admixture with a fraction to be herinafter defined, the effluent from the polymerization zone being then fed to a fractionation zone to collect (a) a fraction containing relatively light olefins and paraffins, (b) fraction containing gasoline and (c) a fraction containing kerosene and gas oil to be treated as hereinafter indicated, wherein the fraction containing relatively light olefins and paraffins is at least partly subjected to an alkylation reaction, the effluent from the alkylation zone being subjected to fractionation from which there is obtained (a) at least one light hydrocarbon cut containing isoparaffins, (b) an alkylate utilizable as motor fuel and (c) a residue, at least a portion of the isoparaffins recovered from said fractionation being recycled to the alkylation zone, the process being further characterized in that said "light oil" and "decanted oil" cuts and the said fraction containing hydrocarbons with 5 or more carbon atoms per molecule and oxygen compounds from the fractionation of the "light fraction" are together subjected to a cracking-decarboxylation treatment, after which treatment, the products from this cracking-decarboxylation treatment are subjected to fractionation, to obtain in addition to undensable gas and a residue, (a) one or more cuts containing olefins with 3 and 4 carbon atoms per molecule and relatively light saturated hydrocarbons, this cut being fed to said polymerization zone to be treated as herinbefore indicated, (b) a heavy gasoline cut and (c) a cut with an ASTM distillation point higher than about 200° C, which cut is admixed with said fraction containing kerosene and gas oil resulting from the fractionation of the products obtained in said polymerization zone and subjected to hydrotreatment, the effluent from this hydrotreatment being subjected to fractionation to obtain a gas cut, a kerosene cut, a gas oil cut and column bottoms, said column bottoms being at least partly recycled to said cracking-decarboxylation zone, in which process said fraction (b) containing gasoline recovered from the fractionation zone following the polymerization zone is admixed with said heavy gasoline cut (b) recovered from the fractionation following the cracking-decarboxylation treatment, and at least a portion of the mixture being thereafter treated in a hydrotreatment zone and then the effluent from said hydrotreatment zone being subjected to fractionation from which gasoline of high purity is recovered.

2. A process according to claim 1, wherein a portion of said mixture is subjected to hydrotreatment and the other portion is not subjected to this hydrotreatment, and wherein the effluent from the hydrotreatment and the portion not subjected to hydrotreatment are recombined and then together subjected to fractionation from which gasoline of high purity is recovered.

3. A process according to claim 1, wherein the alkylation reaction is conducted in the presence of hydrofluoric acid.

4. A process for upgrading effluents from syntheses of the Fischer-Tropsch type or of substantially the Fischer-Tropsch type or of substantially the Fischer-Tropsch type, these effluents being generally formed of three cuts, which have been obtained by fractionating the product of the Fischer-Tropsch synthesis, the first cut or "light fraction" comprised largely of hydrocarbons with 3 to 6 carbon atoms per molecule, these hydrocarbons being largely unsaturated, the second cut or "light oil" comprised largely of hydrocarbons the heaviest of which have an ASTM final distillation point of about 300° C, the third cut or "decanted oil" comprised mainly of hydrocarbons of ASTM distillation point higher than about 300° C, each of the three cuts also containing oxygen compounds, the process being so characterized that, the said light fraction is subjected to fractionation during which, on the one hand, a fraction is discharged, which fraction comprises hydrocarbons with 5 or more carbon atoms per molecule and contains oxygen compounds, and, on the other hand, a fraction is collected, this fraction being fed to a first polymerization zone in admixture with a fraction to be defined later, the effluent from the first polymerization zone being admixed with a cut discharged from a second polymerization zone as hereinafter defined and fed to a fractionation zone to recover (a) a fraction containing relatively light olefins and paraffins, to be treated as hereinafter indicated, (b) a fraction containing gasoline, to be treated as hereinafter indicated, and (c) a fraction containing kerosene and gas oil to be treated as hereinafter indicated, in which process said fraction (a) containing relatively light olefins and paraffins is subjected to an alkylation reaction in the presence of an acid alkylation catalyst, the effluent from the alkylation zone being subjected to fractionation to recover (a) at least one cut of light hydrocarbons containing, among others, isoparaffins and normal paraffins with 3 and 4 carbon atoms per molecule, at least a portion of the isoparaffins with 4 carbon atoms per molecule being recycled to the alkylation zone, (b) an alkylate useful as motor fuel and (c) a bottom product, in which process said fraction (b) containing gasoline, as above defined, discharged from the fraction zone following said first and second polymerization zones, is admixed with a heavy gasoline fraction of ASTM initial distillation point higher than about 100° C and ASTM final distillation point lower than about 200° C, as hereinater defined, at least one part of the resulting mixture is treated in a hydrotreatment zone and the effluent obtained from this hydrotreatment is fed to a fractionation zone to recover essentially a gasoline cut of high purity, in which process said fraction (c) containing kerosene and gas oil, as obtained from the fractionation zone following said first and second polymerization zones, is admixed with a heavy fraction having as ASTM initial distillation point of about 200° C, as hereinafter defined, and supplied to a hydrotreatment zone, as hereinafter defined, the process being further characterized in that the two said "light oil" and "decanted oil" cuts and the fraction comprising hydrocarbons with 5 or more carbon atoms per molecule and also containing oxygen compounds from the fractionation of the "light fraction" are together subjected to a cracking-decarboxylation treatment, after which treatment the products from this cracking-decarboxylation treatment are fractionated to obtain, among others:

(a) an uncondensable gas cut containing hydrocarbons with less than 3 carbon atoms per molecule,
(b) a fraction containing olefins with 3 and 4 carbon atoms per molecule, which fraction is fed to said first polymerization zone,
(c) a cut containing hydrocarbons having 5 carbon atoms or more per molecule and an ASTM final distillation point of about 100° C, which cut is fed to a second polymerization zone, the temperature in said first polymerization zone being lower by 5 to 20° C than the temperature in said second polymerization zone, the pressure in said first polymerization zone being lower by 2 to 10 bars than the pressure in said second polymerization zone and the volume velocity in said first polymerization zone being higher by 0.1 to 0.5 volume of charge per volume of catalyst per hour than the volume velocity in said second polymerization zone, (d) a heavy gasoline fraction of ASTM initial distillation point higher than about 100° C and ASTM final distillation point lower than about 200° C, which fraction is at least partly subjected to hydrotreatment, as above explained, in admixture with the (b) fraction defied above, containing gasoline and discharged from the fractionation zone following said first and second polymerization zones, (e) a heavy fraction with an ASTM initial distillation point of about 200° C, which fraction is admixed with said fraction (c) containing kerosene and gas oil from the fractionation zone following said first and second polymerization zones and fed, as explained above, to a hydrotreatment zone, the effluent from the hydrotreatment zone being subjected to fractionation to recover (a) a gas fraction, (b) a kerosene cut, (c) a gas oil cut and (d) column bottoms, and (f) a residue cut of tar and other heavy products.

5. A process according to claim 4, wherein said column bottoms obtained by fractionation of the effluent from the hydrotreatment zone where have been treated said heavy fraction having an ASTM initial distillation point of about 200° C and said fraction (c) containing kerosene and gas oil, are at least partly recycled to the cracking-decarboxylation zone.

6. A process according to claim 4, wherein said cracking-decarboxylation is carried out in the presence of an acid catalyst at a temperature from 400 to 1200° and at a space velocity of 2 to 10 volumes of liquid charge per volume of catalyst per hour, the catalyst being used in fluid bed, and wherein the two polymerization reactions performed in said first and second polymerization zones are carried out in the presence of a catalyst of acidic type, at a temperature from 100 to 400° C under a pressure of about from 1 to 200 kg/cm$^2$, at a liquid hydrocarbon feed rate of about 0.05 to 5 volumes per volume of catalyst per hour.

7. A process for upgrading effluents from syntheses of the Fischer-Tropsch type or of substantially the Fischer-Tropsch type, these effluents being generally formed of three cuts which have been obtained by fractionating the product of the Fischer-Tropsch synthesis, the first cut or "light fraction" comprising largely of hydrocarbons with 3 of 6 cabon atoms per molecule, these hydrocarbons being largely unsaturated, the second cut or "light oil" comprised largely of hydrocarbons the heaviest of which have an ASTM final distillation point of about 300° C, the third cut or "decanted oil" comprised mainly of hydrocarbons of ASTM distillation point higher than about 300° C, each of the three cuts also containing oxygen compounds, the process being so characterized that the said light fraction is subjected to fractionation during which there is discharged, on the one hand, a fraction containing hydrocarbons with 5 or more carbon atoms per molecule and oxygen compounds and, on the other hand, there is separately obtained a first fraction consisting essentially of hydrocarbons with 3 carbon atoms in the molecule, this fraction containing propylene as the major constituent, and a fraction consisting essentially of hydrocarbons with 4 carbon atoms in the molecule, the fraction consisting essentially of hydrocarbons with 3 carbon atoms in the molecule being fed to a first polymerization zone, the fraction consisting essentially of hydrocarbons with 4 carbon atoms in the molecule being fed to a second polymerization zone, the effluents from the first and second polymerization zones being admixed with a cut from a third polymerization zone, as hereinafter defined, and passed to at least one fractionation zone, in order to obtain:

(a) a fraction containing relatively light olefins and paraffins, said fraction (a) containing relatively light olefins and paraffins, being subjected to an alkylation treatment in order to recover separately LPG and a gasoline fraction, (b) a gasoline containing fraction comprised mainly of hydrocarbons with at least 5 carbon atoms and having an ASTM final distillation point lower than 200° C, (c) a kerosene and gas oil containint fraction, the process being then characterized in that the said "light oil" and "decanted oil" fractions and the said fraction containing hydrocarbons with 5 or more carbon atoms per molecule and also including oxygen compounds, as recovered from the fractionation of the "light fraction", are together subjected to a crack-decarboxylation treatment, after when the products from this cracking-decarboxylation treatment are fractionated, to obtain:

1. an uncondensable gas cut,
2. at least one cut comprising olefins with 3 and 4 carbon atoms per molecule and relatively light saturated hydrocarbons, this cut, of ASTM final distillation point about 100° C, being fed to a third polymerization zone, the polymerization reaction effected in said first polymerization zone being carried out at a temperature lower than the temperatures prevailing in said second and third polymerization zones, in order to mainly dimerize propylene which is the essential component of the fraction fed to said first polymerization zone,
3. a heavy gasoline cut,
4. a cut of ASTM distillation point higher than about 200° C and
5. a residue, the process being further characterized in that said heavy gasoline cut (3) recovered by fractionation of the products obtained from said cracking-decarboxylation, having a distillation point from about 100° (ASTM initial point) to 200° C (final point), is subjected, together with said gasoline fraction (b) obtained when fractionating the effluents from the first, second and third polymerization zones, to hydrogreatment in order to recover a gasoline fraction, the process being further characterized in that, said fraction (c) containing kerosene and gas oil, obtained by fractionation of the effluents from said first, second and third zones, having an ASTM initial distillation point higher than 200° C, is admixed with said cut (4) having a distillation point higher than about 200° C and is supplied to a hydrotreatment zone in order to obtain a kerosene fraction, a gas oil fraction and a column bottom residue.

8. A process according to claim 7, wherein the effluent from the said first polymerization zone, the effluent from the said second polymerization zone and the effluent from the said third polymerization zone are separately fractionated.

9. A process according to claim 7, wherein the said cracking-decarboxylation is carried out in the presence of an acid catalyst at a temperature of 400 to 1200° C, at a space velocity of 2 to 10 volumes of liquid charge per volume of catalyst per hour, the catalyst being used in fluid bed, in which process the 3 polymerization reaction in said first, second and third polymerization zones are carried out in the presence of an acid catalyst at a temperature of 30 to 400° C, a pressure of about 1 to 20 $kg/cm^2$ and a liquid hydrocarbon feed rate of about 0.05 to 5 volumes per volume of catalyst per hour.

* * * * *